United States Patent [19]

Schimko

[11] Patent Number: 4,819,455

[45] Date of Patent: Apr. 11, 1989

[54] FLAT KNITTING MACHINE

[75] Inventor: Reinhold Schimko, Aalen-Wasseralfingen, Fed. Rep. of Germany

[73] Assignee: Universal Maschinenfabrik Dr. Rudolf Schieber GmbH & Co. KG, Fed. Rep. of Germany

[21] Appl. No.: 190,972

[22] Filed: May 6, 1988

[30] Foreign Application Priority Data

May 7, 1987 [DE] Fed. Rep. of Germany ..... 3715212

[51] Int. Cl.[4] ..... D04B 7/00

[52] U.S. Cl. ..... 66/75.1; 66/78; 66/75.2

[58] Field of Search ..... 66/75.1, 78 R, 64 R, 66/75.2

[56] References Cited

U.S. PATENT DOCUMENTS

| | | | |
|---|---|---|---|
| 3,611,753 | 10/1971 | Krause | 66/75.1 |
| 3,715,897 | 2/1973 | Hadam | 66/75.2 |
| 3,955,381 | 5/1976 | Panchaud | 66/75.1 |
| 4,100,767 | 7/1978 | Schieber et al. | 66/75.2 |
| 4,490,994 | 1/1985 | Essig | 66/75.2 |
| 4,662,192 | 5/1987 | Schimko | 66/75.1 |
| 4,715,198 | 12/1987 | Ploppa et al. | 66/75.2 |
| 4,766,742 | 8/1988 | Stoppazzini | 66/75.1 |

FOREIGN PATENT DOCUMENTS

| | | | |
|---|---|---|---|
| 2656824 | 6/1978 | Fed. Rep. of Germany | 66/75.1 |
| 2728343 | 1/1979 | Fed. Rep. of Germany | 66/75.1 |

*Primary Examiner*—Ronald Feldbaum

*Attorney, Agent, or Firm*—Sughrue, Mion, Zinn, Macpeak & Seas

[57] ABSTRACT

A flat knitting machine has in the needle grooves of the needle beds (31) successively arranged spring shaft needles (32) with needle butts (35, 36), slide jacks with butts and displaceable jacquard jacks (34) having respectively two butts as well as a cam system for the selection and activation of the needles and jacks, which has for its part at least two withdrawal cam elements (23, 24) which are displaceable in the cam plane. In order to simplify the construction of the cam and knitting system and to improve its operating properties, the slide jack is designed as a displaceable lifting jack (33) having a lifting jack butt (38) and a stop arranged before said lifting jack butt (38), on which the rear end of the spring shaft needle (32) can impact, the jacquard jack (34) is designed with a jacquard jack butt (39), a selection butt (40) and a slide butt (41) which can be lowered, and in the cam system selection flaps (42) are provided for needle selection and fixed cam parts (43) are provided for lifting selected jacquard jacks (34).

10 Claims, 5 Drawing Sheets

FLAT KNITTING MACHINE

BACKGROUND OF THE INVENTION

The invention relates to a flat knitting machine comprising: spring shaft needles arranged in needle grooves of needle beds, which spring shaft needles are respectively provided with a first forward needle butt always projecting out of the needle bed and a rear second needle butt which disappears due to the resilience of the spring shaft itself in the needle bed; slide jacks arranged behind the spring shaft needles which are respectively provided with a working butt and a front end which is, for the selective raising of the second needle butt slidable, under a spring shaft of the spring shaft needle; jacquard jacks which are arranged behind said slide jacks and are displaceable in sliding manner on them, having at least two butts; and a cam system for the selection and activation of the needles and jacks which has at least two withdrawal cam elements arranged symmetrically to a central longitudinal axis of the cam system and displaceable in the cam plane in the area of the second needle butt.

Such a flat knitting machine is, for example, known from German Patent DE No. 35 23 989 C1. The slide jacks are designed in that case as latch jacks, whereas the needle selection is carried out by the engagement of selection flaps on a selection butt of the jacquard jacks, thereby raising said jacquard jacks.

With the known flat knitting machine the needle groove milling can be achieved in the needle bed without a recess, i.e. in one milling process having a constant milling depth, without the full multiplicity of knitting technologies, including the transfer of stitches and knitting with different withdrawal depths within one row suffering therefrom.

SUMMARY OF THE INVENTION

The invention is based on the object of creating a flat knitting machine of the type described initially in which the structure of the cam and knitting system is further simplified and the operating properties are additionally improved.

This object is achieved in accordance with the invention in that:

(a) the slide jack is designed as a purely displaceable lifting jack having a lifting jack butt and a stop arranged in front of it, on which the rear needle end of the spring shaft needle can impact when the spring shaft is raised, (b) the jacquard jack is designed with a front jacquard jack butt, a central selection butt and a rear sliding butt which can be selectively lowered into the needle bed, and (c) pivotable selection flaps are provided in the cam system for selective needle selection by cooperation with the selection butts and fixed cam parts are provided in the cam system for raising selected jacquard jacks by engagement with their sliding butt.

When using a cam and knitting system of the flat knitting machine constructed in this way, a cam system for constant needle withdrawal which is simple in structure and in operation is realized.

Advantageously, in the cam system, arranged in the area of the first needle butts symmetrically to the central longitudinal axis of the cam system two further withdrawal cam elements which are displaceable in the cam plane, and a cam part symmetrical to the central longitudinal axis and shiftable into and out of the cam plane, and in the area of the second needle butts and of the lifting jack butts, respectively four further cam parts are provided which are shiftable into and out of the cam plane. This results in a cam system for selective needle withdrawal.

Using the flat knitting machine in accordance with the invention, a needle selection possibility is created which realizes the full multiplicity of knitting technologies including the transfer of stitches and knitting at different withdrawal depths within a row of knitting, with a very simple and compact cam structure which is safe in operation.

The further shiftable cam parts in the area of the second needle butts, as well as the further shiftable cam parts in the area of the lifting jack butts, are respectively arranged expediently to be symmetrical to the central longitudinal axis of the cam system.

For the formation of long and short stitches, the shiftable cam part in the area of the first needle butts and the shiftable cam parts in the area of the second needle butts and of the lifting jack butts can advantageously be shifted into action, whereas for the formation of long stitches and short tuck stitches, the shiftable cam part in the area of the first needle butts and the shiftable cam parts in the area of the second needle butts can be shifted out of action while the shiftable cam parts in the area of the lifting jack butts can be shifted into action.

Expediently the shiftable cam part in the area of the first needle butts and the shiftable cam parts in the area of the second needle butts as well as the shiftable cam parts in the area of the lifting jack butts can be respectively and jointly shifted into and out of the cam plane.

Advantageously a cam part is provided which is symmetrical to the central longitudinal axis of the cam system in order to retain the lifting jack on its lifting jack butt against a withdrawal movement on its upper cam part edge and against a raising movement on its lower cam part edge. On a first selection position it is advantageous for two fixed cam parts to be arranged symmetrically to the central longitudinal axis of the cam system for the counter-driven separation of the jack butts and of the front jacquard jack butts, while at a second selection position, a fixed cam part which is symmetrical to the central longitudinal axis of the cam system is provided for raising the lifting jack butts and for holding the jacquard jack butts against a raising movement. It is understood that respectively two first selection positions and two second selection positions are provided which are arranged symmetrically to the central longitudinal axis of the cam system in order to be able to implement the full multiplicity of the knitting processes in every direction of movement of the carriage.

The selection butts of successive jacquard jacks and the associated selection flaps are expediently arranged in echelon in a manner known per se in the longitudinal direction of the needle grooves.

The invention is explained in more detail below on the basis of embodiments and of the drawings. The drawings show in:

FIG. 1 a plan view of a preferred embodiment of a cam system for selected needle withdrawal in accordance with the invention schematically illustrated, FIG. 2 a plan view of an embodiment of a cam system for constant needle withdrawal in accordance with the invention schematically illustrated, FIG. 3 the cam system for selective needle withdrawal in accordance with FIG. 1 to illustrate the course of the needles and jacks for the three-way technology, FIGS. 4 to 9 cross-sections through a needle bed along a needle groove for different positions of spring shaft needles, lifting jacks and jacquard jacks, FIG. 10 a plan view as in FIG. 1, shifted for the formation of long and short stitches, FIG. 11 a plan view as in FIG. 1, shifted for the formation of long stitches and short tuck-loops, FIG. 12 a plan view as in FIG. 2 for the illustration of the course of the needles and jacks for the three-way technology, and FIG. 13 a plan view as in FIG. 2 for the illustration of the course of the needles and jacks during the transfer of stitches.

The cam system for selective needle withdrawal as shown in FIG. 1 consists of fixed cam parts which are not shaded, five shaded cam parts 16, 17, 18, 19, 20, which are controllable and which can be brought at discretion out of and into action, and four displaceable withdrawal cam elements 21, 22, 23 and 24 which can be moved in the direction of the double arrow. Here, as in the following passages, the cam parts 16, 17, 18, 19 and 20 are always shown shaded when they are shifted out of action out of the cam plane. The cam system is symmetrical to its central longitudinal axis M.

FIG. 2 shows a cam system for constant needle withdrawal which consists apart from the withdrawal cam elements 23, 24 which are displaceable in the direction of the double arrow solely of unshaded fixed cam parts. This cam system is also constructed symmetrically to its central longitudinal axis M.

On the basis of FIG. 3, below a description is given of the needle and jack motion for the three-way technology by the cam system for selective needle withdrawal. Here the shaded cam parts 16, 17, 18, 19, 20 are out of action.

The arrows A in FIG. 3 and FIGS. 10 to 13 indicate the direction of movement of the cam system from right to left. FIG. 3 shows different positions 1 to 15 for a spring shaft needle 32, a lifting jack 33 and a jacquard jack 34. These positions in detail are as follows:

Position 1: basic position in comb level position
Position 2: jacquard selection/stitch/transfer
Position 3: needle butt raised—begin transfer
Position 4: needle out of action
Position 5: begin stitch
Position 6: jacquard selection/tuck
Position 7: needle butt raised—begin tuck
Position 8: stitch
Position 9: tuck
Position 10: stitch
Position 11: tuck
Position 12: stitch
Position 13: tuck
Position 14: stitch
Position 15: basic position.

FIGS. 4 to 9 show in a needle groove of constant depth successively arranged in a needle bed 31 a spring shaft needle 32, a lifting jack 33 and a jacquard jack 34 in different working positions. The spring shaft needle 32 has a central needle butt 35 which constantly projects out of needle bed 31 and a needle butt 36 which can be lifted resiliently out of the needle bed 32 by means of the lifting jack 33 on the needle end 37. The lifting jack 33 has a lifting jack butt 38. The jacquard jack 34 has a front jacquard jack butt 39, a central selection butt 40 and a rear sliding butt 41. In FIGS. 1 and 2 the positions 1 and 15—basic position—of the needle butt 35 which projects constantly out of needle bed 31, of the needle butt 36 which can be resiliently raised, of the lifting hook butt 38 and of the front jacquard jack butt 39 are illustrated. The black needle heels are in action and the light needle butts are out of action.

FIG. 4 shows spring shaft needle 32, lifting jack 33 and jacquard jack 34 in position 1—the basic position. A selection flap 42 is pivoted on the selection butt 40 so that a cam part 43 is engaged with the sliding butt 41 of the jacquard jack 34 projecting out of the needle bed 31 for raising the jacquard jack 34.

FIG. 5 shows spring shaft needle 32, lifting jack 33 and jacquard jack 34 in position 2 for jacquard selection/stitch/transfer. The leading end of the lifting jack 33 is in contact with the needle end 37.

In FIG. 6 the spring shaft needle 32, lifting jack 33 and jacquard jack 34 are shown in position 3—with needle butt 36 raised, beginning of transfer. A cam part a 44 is located between lifting jack butt 38 and the front jacquard jack butt 39 and it presses the lifting jack 33 and the jacquard jack 34 apart. A cam part 45 engages the needle butt 35 which constantly projects out of the needle bed and prevents any raising of the spring shaft needle 32 above comb level. The raisable needle butt 36 projects out of the needle bed 31.

FIG. 7 provides an illustration of spring shaft needle 32, lifting jack 33 and jacquard jack 34 in position 8—stitch formation.

FIG. 8 shows spring shaft needle 32, lifting jack 33 and jacquard jack 34 in position 10—stitch formation. The needle butt 36 which can be resiliently raised is lowered out of action in the needle bed 31.

FIG. 9 shows spring shaft needle 32, lifting jack 33 and jacquard jack 34 in position 12—stitch formation. Here the lifting jack 33 again engages from below the spring shaft needle 32, so that its raisable needle butt 36 projects out of the needle bed 31 in the working position.

FIGS. 3 and 4, position 1 show the needle and jacks in the basic position. In needle bed 31, the spring shaft needle 32, the lifting jack 33 and the jacquard jack 34 are arranged behind each other on a constantly deep needle groove bottom. If the needle butt 36 is to be moved into the working position, the jacquard jack 34 must be selected and preselected with the lifting jack 33. The selection flap 42 is pivoted away, the jacquard jack 34 remains in its raised position (or the position in which it is not pressed away) so that the cam part 43 engages the sliding butt 41 and guides the jacquard jack 34 as well as the lifting jack 33 to the right as far as the needle end 37, compare FIGS. 3 and 5, position 2.

In the further cycle, the cam part 44 takes over the task of moving the lifting jack 33 further upwards and the jacquard jack 34 further downwards, compare FIGS. 3 and 6, position 3.

The cam part 45 holds the spring shaft needle 32 on the needle butt 35 in its position, so that the lifting jack 33 can slide under the needle butt 36 and bring the latter into the cam area.

This first selection position—position 2—is used for selection of the stitch formation or for raising the needle for stitch transfer.

If stitches are to be transferred, in the last carriage reversal, the withdrawal cam element 23 is shifted into the lower interrupted position. The withdrawal cam element 23 therefore engages the needle butt 36 and it pushes the spring shaft needle 32 upwards until the latter is engaged at needle butt 35 by a transfer cam part 46.

If a stitch is formed, the withdrawal cam element 23 remains in the comb level position, so that the needle butt 36 is only engaged by a cam part 47 and is driven upwards by the latter until the needle butt 35 is engaged by an upper needle lifting cam element 48, compare FIG. 3 and position 8.

On further lifting, see position 10 in FIGS. 3 and 8, the lifting jack butt 38 is held by a cam part 49. The needle butt 36 slides down from the lifting jack 33 and disappears in the needle groove, compare FIG. 8, position 10.

In the subsequent downwards movement of spring shaft needle 32 into the thread insertion position, see FIGS. 3 and 9, position 12, the lifting jack 33 is held by a cam part 50. The needle butt 36 slides on the lifting jack 33, moves out of the needle groove and appears in its working position, compare FIG. 9, position 12.

The spring shaft needle 32 is now withdrawn by the withdrawal cam element 24 to the preselected depth and is brought by a cam part 51 into the initial position or basic position—position 15 in FIG. 3—i.e. to comb level position, in which the needle butt 36 is lowered in the needle groove.

The second selection position for tuck or transfer—position 6 in FIG. 3—brings the needle butt 36 into its working position in such manner that the needle butt 36 is engaged by cam part 49 and the spring shaft needle 32 is raised by cam part 49 until needle butt 35 comes into the area of a cam part 52 and with the aid of the latter is raised to tuck level. The lifting jack butt 38 is held in this process by cam part 50, compare FIG. 3, position 11. The needle butt 36 slides down from the lifting jack 33 and disappears in the needle groove.

In the further cycle—position 13, FIG. 3—the lifting jack butt 38 is raised by a cam parter 53, the spring shaft needle 32 is held at tucking level and the needle butt 36 is again brought into action by the lifting jack 33, so that the spring shaft needle 32 can be withdrawn by the withdrawal cam element 24 to the preset withdrawal depth.

If both the selection positions are uninfluenced, i.e. if the selection flap 42 does not pivot outwards, the jacquard jack 34 is pressed with its rear end into the needle groove and the sliding butt 41 is not engaged by cam part 43. The needle butt 36 remains lowered in the needle groove and consequently cannot be engaged by any cam part. The spring shaft needle 32 remains out of action.

The needle selection for the transfer of stitches is carried out in the same manner as is used for tucking selection.

The movement of the needles for knitting long and short stitches is illustrated in FIG. 10. Here the controllable cam parts 16 to 20 are brought into action. At the first selection position—position 2—those needles are selected which are to knit long stitches, and at the second selection position—position 6—those needles are selected which are to knit short stitches. The upper withdrawal cam elements 22 form the short stitches and the lower withdrawal cam elements 24 form the long stitches.

The cycle of the needles and jacks which are selected in the first selection position—position 2—is the same as was described in connection with FIG. 3 for three-way technology stitches. The cycle of the needles and jacks which are to form short stitches begins at the second selection position, position 6, in FIG. 10—position 6—the needle butt 36 which has been raised into action is engaged by cam part 17 and is raised until the needle butt 35 is taken over by cam part 16. The cam part 48 then brings the spring shaft needle 32 to complete the stitch. On the way, see position 11, the lifting jack 33 remains held by cam part 50. The needle butt 36 slides down from lifting jack 33 and disappears in the needle groove. Because cam part 20 has been brought into action, the lifting jack 33 is subsequently drawn into its initial position. In the further cam cycle, the needle butt 36 is no longer engaged by lifting jack 33, and therefore it remains out of action and this needle is drawn down to a lesser extent by the needle butt 35 which is constantly in action from the upper withdrawal cam element 22. The needle butt 36 which is out of action cannot be engaged by withdrawal cam element 24 and therefore it slides past under the latter.

FIG. 11 shows the needle cycle for long stitches and short tuck loops. The cam parts 16, 17 and 18 are out of action and the cam parts 19 and 20 are switched on. At position 2, the needle selection for long stitches is effected. The further movement of the needles is the same as already described for three-way technology, FIG. 3.

The needles which are not to form any tuck loops are selected during the tuck selection, FIG. 3, position 6. The movement of the needles and jacks is the same as shown in FIG. 3. But because the cam part 20 is switched on, the lifting jack 33 is withdrawn there, so that in position 14 a decoupling takes pace and the needle which forms tuck loops can no longer be engaged at its butt 36 by the withdrawal cam element 24.

Figure 1:
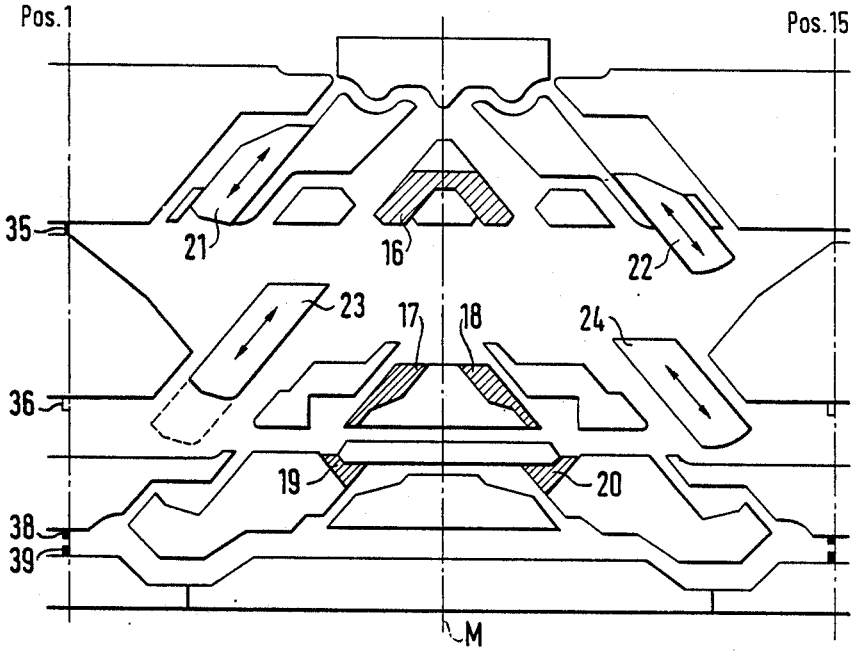
Figure 2:
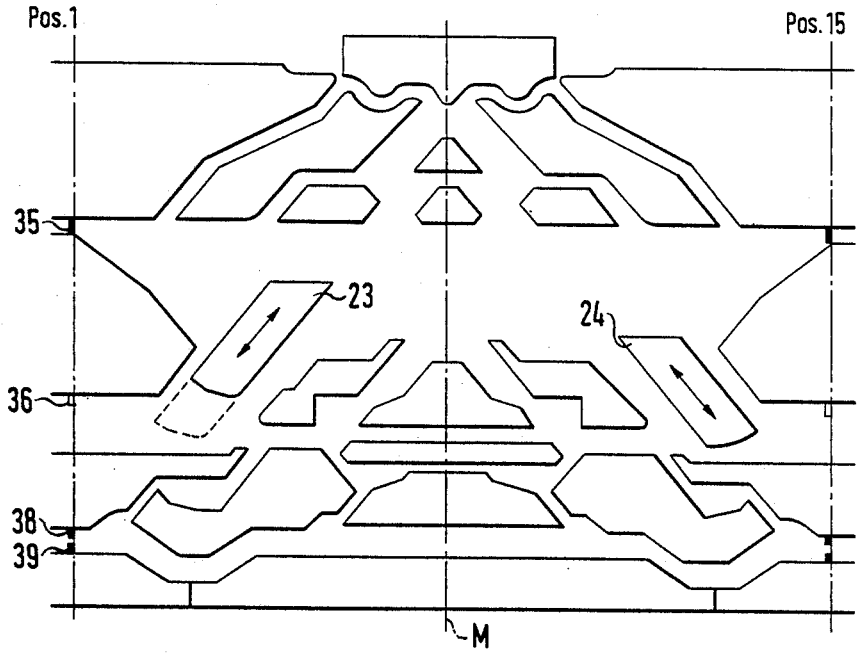
Figure 3:
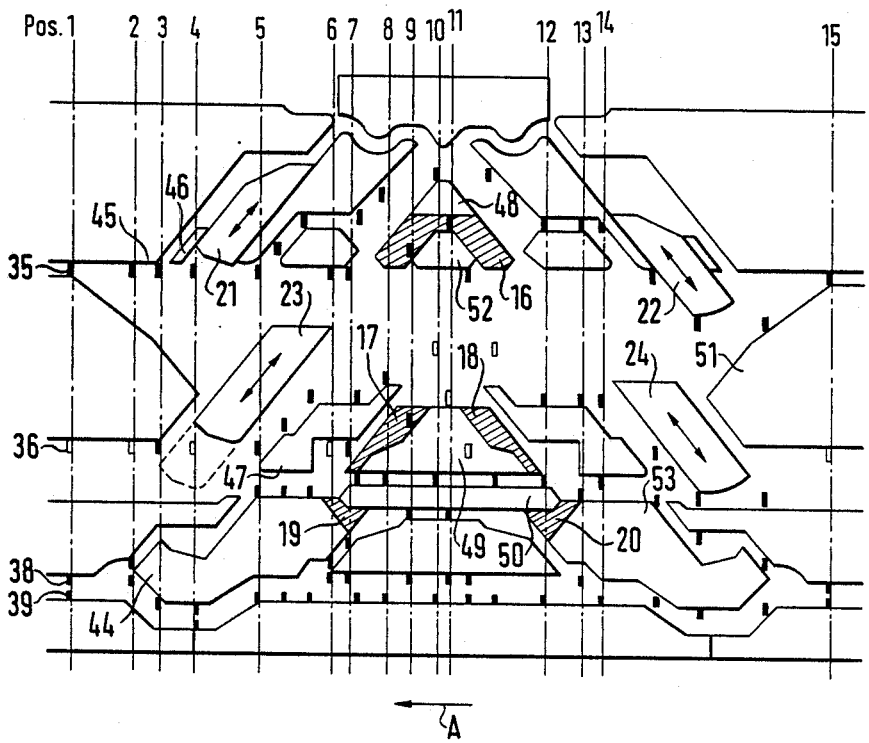
Figure 4:
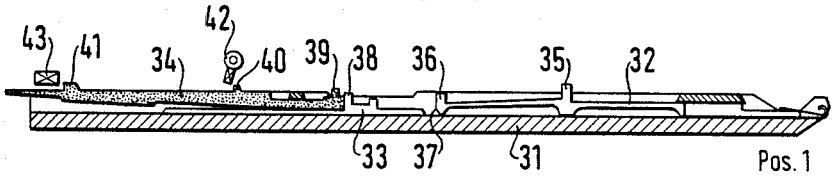
Figure 5:
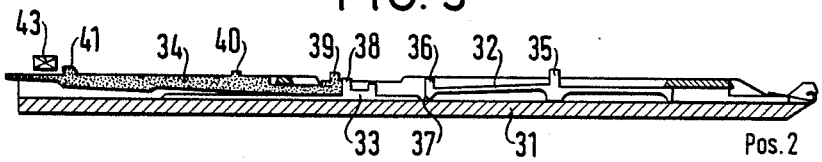
Figure 6:
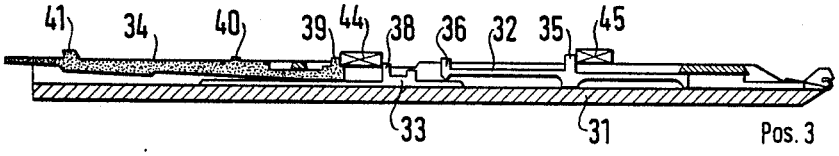
Figure 7:
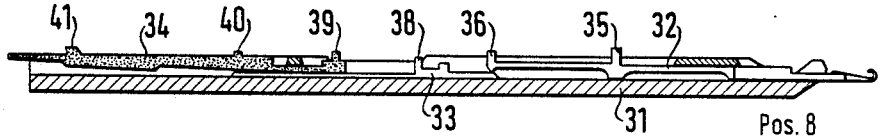
Figure 8:
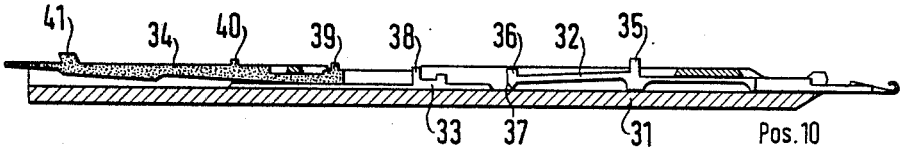
Figure 9:
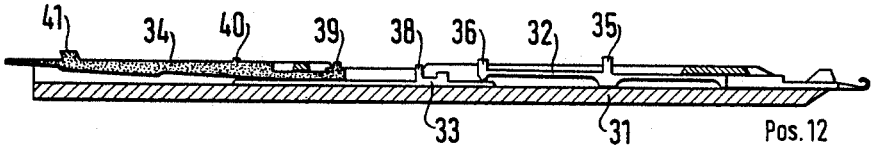
Figure 10:
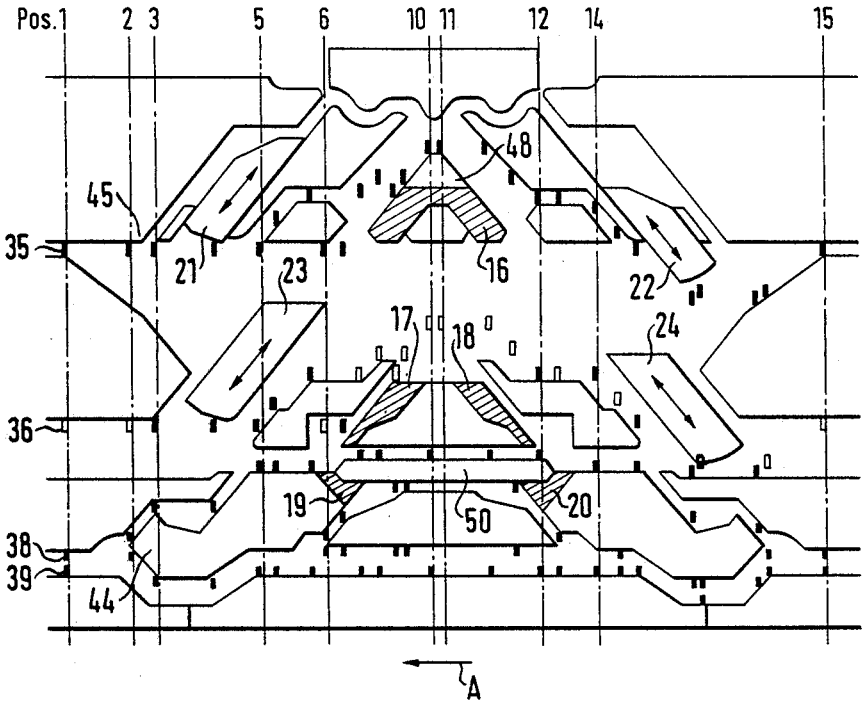
Figure 11:
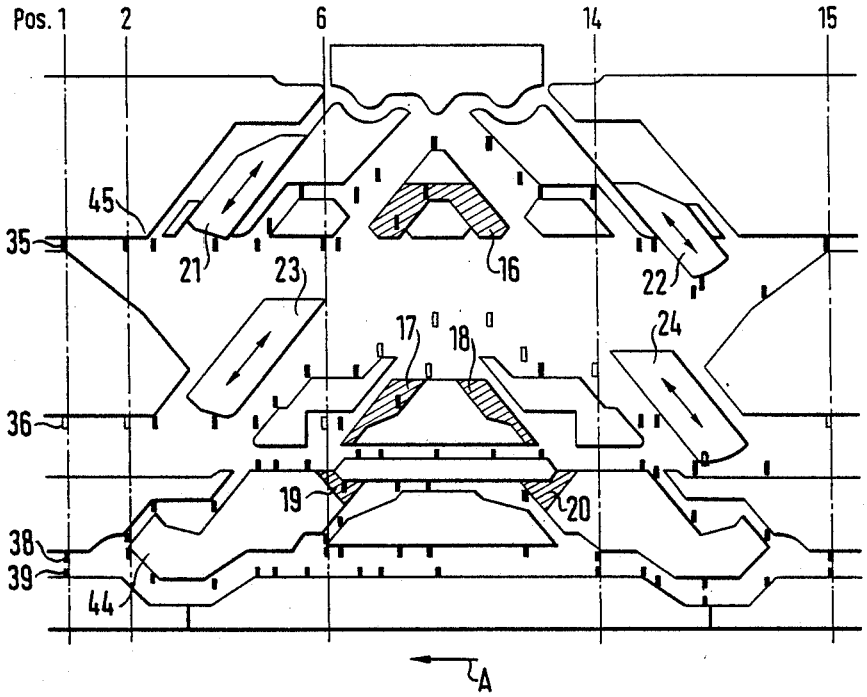
Figure 12:
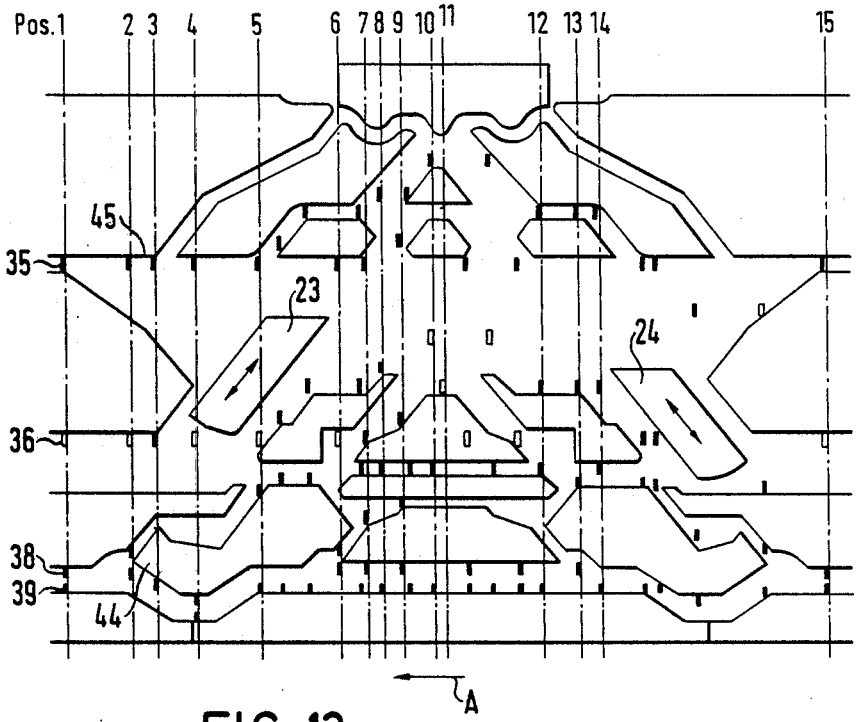
FIG. 12 shows the cam system for constant needle withdrawal (FIG. 2) with a needle and jack cycle for three-way technology.
Figure 13:
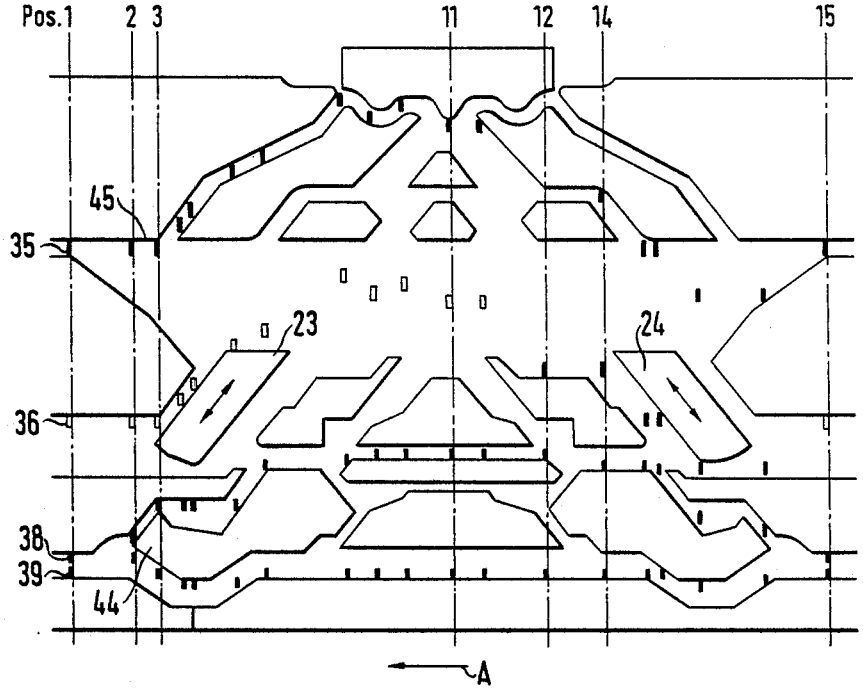
FIG. 13 shows the cam system for constant needle withdrawal (FIG. 2) with a needle and jack cycle for stitch transfer.

Reference numbers in the claims are intended for better understanding and shall not restrict the scope of the claims.

What is claimed is:

1. A flat knitting machine comprising:

spring shaft needles (32) arranged in needle grooves of needle beds (31), which spring shaft needles (32) are respectively provided with a first forward needle butt (35) always projecting out of the needle bed (31) and a rear second needle butt (36) which disappears due to the resilience of the needle shaft itself in the needle bed (31);

slide jacks arranged behind the spring shaft needles (32) which are respectively provided with a working butt an a front end which is for the selective raising of the second needle butt (36) slidable under a spring shaft of the spring shaft needle (32);

jacquard jacks (34) which are arranged behind said slide jacks and are displaceable in sliding manner on them, having at least two butts; and a cam system for the selection and activation of the needles and jacks which has at least two withdrawal cam elements (22, 24), arranged symmetrically to a central longitudinal axis (M) of the cam system and displaceable in the cam plane, in the area of the second needle butt (36), (a) the slide jack being designed as a purely displaceable lifting jack (33) having a lifting jack butt (38) and a stop arranged in front of it, on which the rear needle end (38) of the spring shaft needle (32) can impact when the spring shaft is raised, (b) the jacquard jack (34) being designed with a front jacquard jack butt (39), a central selection butt (40) and a rear sliding butt (41) which can be selectively lowered into said needle bed (31), and (c) pivotable selection flaps (42) being provided in the cam system for selective needle selection by cooperation with the selection butts (40), and fixed cam parts (43) being provided in the cam system for raising selected jacquard jacks (34) by engagement on their sliding butt (41).

2. Flat knitting machine as set forth in claim 1, wherein in the cam system, arranged in the area of the first needle butts (35) symmetrically to the central longitudinal axis (M) of the cam system, two further withdrawal cam elements (21, 22) which are displaceable in the cam plane, and a cam part (16) symmetrical to the central longitudinal axis (M) and shiftable into and out of the cam plane, and in the area of the second needle butts (36) and of the lifting jack butts (38), respectively four further cam parts (17, 18, 19, 20) are provided which are shiftable into and out of the cam plane.

3. Flat knitting machine as set forth in claim 2, wherein the further shiftable cam parts (17, 18) in the area of the second needle butts (36) and the further cam parts (19, 20) in the area of the lifting jack butts (38) are respectively arranged symmetrically to the central longitudinal axis (M) of the cam system.

4. Flat knitting machine as set forth in claim 3, wherein for the formation of long and short stitches, the shiftable cam part (16) in the area of the first needle butts (35) and the shiftable cam parts (17, 18, 19, 20) in the area of the second needle butts (36) and of the lifting jack butt (38) can be switched into action.

5. Flat knitting machine as set forth in claim 3, wherein for the formation of long stitches and short tuck loops, the shiftable cam part (16) in the area of the first needle butts (35) and the shiftable cam parts (17, 18) in the area of the second needle butts (36) can be switched out of action while the shiftable cam parts (19, 20) in the area of the lifting jacks butts (38) can be switched into action.

6. Flat knitting machine as set forth in claim 2, wherein the shiftable cam part (16) in the area of the first needle butts (35) and the shiftable cam parts (17, 18) in the area of the second needle butts (36) as well as the shiftable cam parts (19, 20) in the area of the lifting jack butts (38) can be respectively and jointly switched into and out of the cam plane.

7. Flat knitting machine as set forth in claim 1, wherein a cam part (50) is provided which is symmetrical to the central longitudinal axis (M) of the cam system for holding the lifting jack (33) on its lifting jack butt (38) against a withdrawal movement on its upper cam part edge and against a lifting movement on its lower cam part edge.

8. Flat knitting machine as set forth in claim 1, wherein two fixed cam parts (4) which are arranged symmetrically to the central longitudinal axis (M) of the cam system are provided for the counter-separation of the lifting jack butts (38) and the front jacquard jack butts (39) at a first selection position (position 2).

9. Flat knitting machine as set forth in claim 1, wherein a fixed cam part which is symmetrical to the central longitudinal axis (M) of the cam system is provided for raising the lifting jack butts (38) and holding the jacquard jack butts (39) against a lifting movement at a second selection position (position 6).

10. Flat knitting machine as set forth in claim 1, wherein the selection butts (40) of successive jacquard jacks (34) and the associated selection flaps (42) are disposed in echelon in the longitudinal direction.

* * * * *